US006773256B2

(12) United States Patent
Joshi et al.

(10) Patent No.: US 6,773,256 B2
(45) Date of Patent: Aug. 10, 2004

(54) ULTRA LOW NOX BURNER FOR PROCESS HEATING

(75) Inventors: Mahendra Ladharam Joshi, Allentown, PA (US); Kevin Ray Heier, Macungie, PA (US); Aleksandar Georgi Slavejkov, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 9 days.

(21) Appl. No.: 10/067,450

(22) Filed: Feb. 5, 2002

(65) Prior Publication Data

US 2003/0148236 A1 Aug. 7, 2003

(51) Int. Cl.[7] ..... F23D 14/58; F23D 14/84

(52) U.S. Cl. ..... 431/9; 431/8; 431/115; 431/187; 431/284

(58) Field of Search ..... 431/350, 284, 431/353, 187, 115, 8, 9, 10

(56) References Cited

U.S. PATENT DOCUMENTS

| | | | | | |
|---|---|---|---|---|---|
| 4,505,666 | A | * | 3/1985 | Martin et al. | 431/10 |
| 5,073,105 | A | | 12/1991 | Martin et al. | 431/116 |
| 5,098,282 | A | * | 3/1992 | Schwartz et al. | 431/9 |
| 5,195,884 | A | | 3/1993 | Schwartz et al. | 431/8 |
| 5,275,552 | A | | 1/1994 | Schwartz et al. | 431/10 |
| 5,413,477 | A | | 5/1995 | Moreland | 431/9 |
| 5,634,785 | A | * | 6/1997 | Bury et al. | 431/9 |
| 5,667,376 | A | | 9/1997 | Robertson et al. | 431/115 |
| 5,688,115 | A | * | 11/1997 | Johnson | 431/9 |
| 5,743,723 | A | * | 4/1998 | Iatrides et al. | 431/8 |
| 5,957,682 | A | | 9/1999 | Kamal et al. | 431/328 |
| 6,027,330 | A | | 2/2000 | Lifshits | 431/8 |
| 6,499,990 | B1 | * | 12/2002 | Zink et al. | 431/8 |

OTHER PUBLICATIONS

R. K. Agrawal and S. C. Wood, "Cost–Effective NOx Reduction", *Chemical Engineering*, Feb. 2001, pp. 78–82.

D. Keith Patrick, "Reduction and Control of NOx Emissions from High Temperature Industrial Processes", *Industrial Heating*, Mar. 1998, pp. 77–85.

* cited by examiner

*Primary Examiner*—Sara Clarke
(74) *Attorney, Agent, or Firm*—Keith D. Gourley

(57) ABSTRACT

An ultra low NOx burner for process heating is provided which includes a fluid based flame stabilizer which provides a fuel-lean flame at an equivalence ratio in the range of phi=0.05 to phi=0.3 and fuel staging lances surrounding the flame stabilizer in circular, flat, or load shaping profiles, each lance comprising a pipe having a staging nozzle at a firing end thereof, each lance having at least one hole for staging fuel injection, and each hole having a radial divergence angle and an axial divergence angle. The at least one hole and the divergence angles provide circular, flat or load shaping flame pattern. The burner provides NOx emissions of less than 9 ppmv at near stoichiometry combustion conditions.

26 Claims, 11 Drawing Sheets

Vertical Plane pointed to LSV

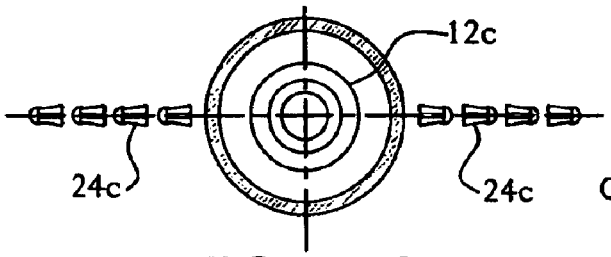

Firing Rate: 4 MM Btu/Hr
Fuel Lances: 8, 2 holes/lance
0.1094"ϕ, 15°/ 7°
Fuel Prs: 4.75 psig; Air: 1.6 iwc
Furnace Temp ~ 1499°F:
O2=1.8%, CO=10ppm, NO=5 ppmv

FIG. 11A

Vertical Plane pointed to LSV

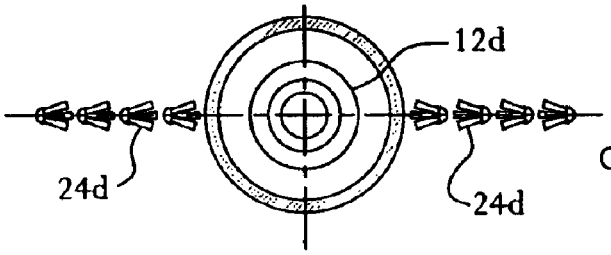

Firing Rate: 4 MM Btu/Hr
Fuel Lances: 8, 3 holes/lance, 0.14,
0.094" ϕ, 20°/ 7°/12°
Fuel Prs: 3 psig; Air: 1.6 iwc
Furnace Temp ~ 1566°F:
O2=1.0%, CO=20ppm, NO=6 ppmv

FIG. 11B

Inclined Plane Straight Out

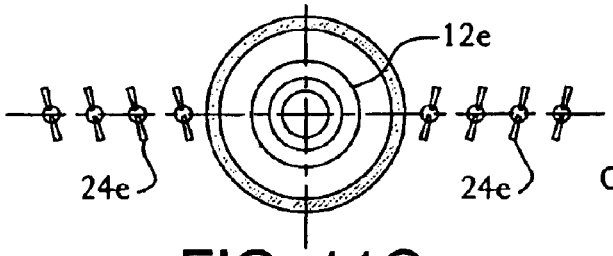

Firing Rate: 4 MM Btu/Hr
Fuel Lances: 8, 2 holes/lance
01096" ϕ, 15°, 20° inclin
Fuel Prs: 5 psig; Air: 1.6 iwc
Furnace Temp ~ 1500°F:
O2=2.1%, CO=200ppm, NO=5 ppmv

FIG. 11C

Vertical Plane + Circular

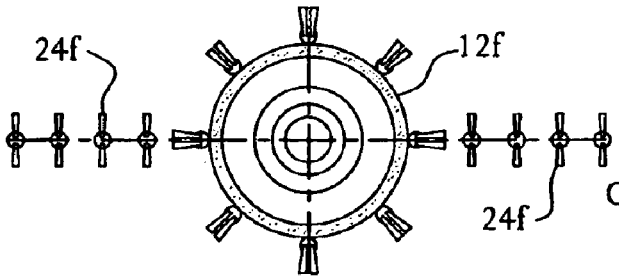

Firing Rate: 4 MM Btu/Hr
Fuel Lances: 16, 2 holes/lance
01096" ϕ, 7°,15°
Fuel Prs: 2.5 psig; Air: 1.6 iwc
Furnace Temp ~ 1498°F:
O2=1.5%, CO=25ppm, NO=6.5 ppmv

FIG. 11D

ULTRA LOW NOX BURNER FOR PROCESS HEATING

BACKGROUND OF THE INVENTION

The present invention is directed to a gaseous fuel burner for process heating. In particular, the present invention is directed to a burner for process heating which yields ultra low nitrogen oxides (NOx) emissions.

Energy intensive industries are facing increased challenges in meeting NOx emissions compliance solely with burner equipment. These burners commonly use natural gas as a fuel due to its clean combustion and low overall emissions. Industrial burner manufacturers have improved burner equipment design to produce ultra low NOx emissions and call them by the generic name of "Low NOx Burners" (LNBs) or various trade names. Table I (Source: North American Air Pollution Control Equipment Market, Frost & Sullivan) gives the LNB market share based on industry for the year 2000. An objective for new burners is to target the industrial sectors that have the largest need for LNBs based on geographic region and local air emission regulations.

TABLE I

Low NOx Burner Market

| Year Generation | Public Utilities (%) | Incineration (%) | Refinery or CPI (%) | Power Generation (%) | Paper, Food, Rubber, Other (%) |
|---|---|---|---|---|---|
| 2000 | 46.5 | 15 | 21.3 | 6.4 | 10.8 |

As shown in Table I, public utilities and refineries (Chemical and Petroleum Industries) utilize the largest share of low NOx burners. These burners are used in industrial boilers, crude and process heaters (atmospheric and vacuum furnaces) and hydrogen reformers (steam methane reformers).

Nitrogen oxides (NOx) are among the primary air pollutants emitted from combustion processes. NOx emissions have been identified as contributing to the degradation of environment, particularly degradation of air quality, formation of smog (poor visibility) and acid rain. As a result, air quality standards are being imposed by various governmental agencies, which limit the amount of NOx gases that may be emitted into the atmosphere.

Primary goals in combustion processes related to the above are to (1) decrease the NOx emissions levels to <9 parts per million by volume (ppmv) and (2) improve the overall heat transfer uniformity and combustion efficiency of process heaters, boilers and industrial furnaces. For example, in southern California, for process heaters with a firing capacity greater than 20 MM Btu/hr, it is required that the NOx emissions be less than 7 ppmv and that the exhaust gas stream from the process heaters must be vented to a Selective Catalytic Reduction (SCR) unit. At present, this is only possible using best available control technology such as an SCR system. The SCR systems use post treatment of flue gas by reaction of ammonia in the presence of a catalyst to destruct NOx into nitrogen. In addition, California law also requires a fixed temperature window (600° F. to 800° F.) for >90% NOx removal efficiency as well as the avoidance of ammonia slip below 5 ppmv. A typical SCR unit for a 100 million Btu/hr process heater would cost approximately $700,000 in capital costs with annual operating costs of $200,000. See, for example, Table 2 of R. K. Agrawal and S.C. Wood, "Cost-Effective NOx Reduction", *Chemical Engineering*, February 2001.

The above compliance costs create a higher cost burden on furnace/process plant operators or utility providers. Generally, emission control costs are transferred to the public in the form of higher overall product costs, local taxes and/or user fees. Thus, power utilities and process plants are looking for more cost effective NOx reduction technologies that would control NOx emissions from the source and do not require post treatment of flue gases after NOx is already formed.

In order to comply cost-effectively for NOx emissions, many combustion equipment manufacturers have developed LNBs. See, e.g., D. Keith Patrick, "Reduction and Control of NOx Emissions from High Temperature Industrial Processes", *Industrial Heating*, March 1998. The cost effectiveness of an LNB compared to the SCR system would generally depend on the type of burner, consistent NOx emissions from burner, burner costs and local compliance levels. In many ozone attainment areas, the LNBs (for >40 MM Btu/hr) have not been capable of producing low enough NOx emissions to comply with regulations or provide an alternative to SCR units. Therefore, SCR remains today as the only best available control technology for large process heaters and utility boilers.

The greatest challenge in designing a low NOx burner is keeping NOx emissions consistently at sub 9 ppmv level or comparable to NOx emissions at the outlet of the SCR system. The prior art includes low NOx or ultra low NOx burners that produce low NOx emissions using various fuel/oxidant mixing techniques, fuel/oxidant staging techniques, flue gas recirculation, stoichiometry variations, fluid oscillations, gas rebuming and various combustion process modifications. However, most burners are unable to produce NOx emissions at less than 9 ppmv and those that do so in a lab, cannot reproduce such NOx levels in an industrial setting. The technical reasons or challenges in designing a sub 9 ppmv low NOx burner will become evident as described below.

Most large capacity gaseous fuel fired industrial burners used for process heating applications are nozzle mixing type burners. As the name implies, the gaseous fuel and combustion air do not mix until they leave various fuel/oxidant ports of this type of burner. The principal advantages of nozzle mix burners over premix burners are: (1) the flames cannot flash back, (2) a wider range of operating stoichiometry; and (3) a greater flexibility in burner/flame design. However, most nozzle mix air-fuel burners require some kind of flame holder/arrester for maintaining flame stability. One prior art generic nozzle mix burner is shown in FIG. 1, where a metallic flame holder disk is used for providing flame stability. Here, combustion air is induced surrounding the main fuel pipe with flame holder in a large box type burner shell.

The example burner of FIG. 1 also uses staging fuel for secondary combustion to reduce overall NOx formation. However, for successful staged combustion processes, it is very important to have a stable primary flame attached to the flame holder. FIG. 2 shows a typical flame holder geometry in which a multiple-hole fuel nozzle is located in the center and several perforated slots are used on the flame holder conical disk outside for passing through a small amount of combustion air for mixing with the injected fuel. The bluff body shape flame holder creates an air stream reversal as shown in FIG. 2. The opposite direction air stream creates almost stagnant condition (zero axial velocity) for air fuel mixing at the inside cavity of the flame holder cone. This stagnant air-fuel mixture with almost no positive firing axis velocity component is used for attaching the main flame to the flame holder base.

Flame holders of various hole patterns and external shapes (conical, perforated disk, ring, etc.) are used for anchoring flames. For example, U.S. Pat. No. 5,073,105 (Martin, et al.) and U.S. Pat. No. 5,275,552 (Schwartz et al.) describe low NOx burner devices where such flame holders are used to anchor the flame. In U.S. Pat. No. 5,073,105, a primary fuel (30–50% of total fuel) is injected radially inwardly over the flame holder disk with flue gas entrainment (through a hole in the burner tile) for anchoring the primary flame. The remaining, secondary fuel is injected surrounding and impacting the external burner block (tile) surface for fuel staging and furnace gas recirculation. Combustion air mixing with the primary fuel takes place inside the burner block over the flame holder and some NOx is formed due to limited heat dissipation volume inside the burner block cavity and due to creation of locally fuel rich regions.

A very similar approach involving flame holder, primary fuel and secondary fuel injection is used in U.S. Pat. No. 5,275,552. Here, the primary gas, with entrained furnace gas through holes in the burner tile, is swirled in the burner block cavity for better mixing. The swirling primary fuel/flue gas mixture enables better flame anchoring on the flame holder surface.

A main disadvantage associated with flame holders for use in ultra low-NOx burners is localized stagnant zones of fuel-rich combustion that are generally anchored at the inner base of a flame holder cone or disk. These zones are located on the solid ridges between adjacent air slots/holes due to pressure conditions created by the outer air stream. The fuel-rich or sub-stoichiometric mixtures found at the flame holder base for flame stability are unfortunately ideal for formation of C=N bonds through the reaction $CH+N_2=HCN+N$. Subsequent oxidation of HCN leads to flame holder derived prompt NO formation.

Another main disadvantage associated with flame holders for use in ultra low-NOx burners is limited flame stability if the same burner is operated extremely fuel-lean to avoid prompt NO formation. The overall equivalence ratio (phi) is limited to 0.2 to 0.4 for most flame holder based burners Finally, a third main disadvantage associated with flame holders for use in ultra-low-NOx burners is that overheating or thermal oxidation of flame holders is quite common due to high temperature flame anchoring, localized reducing atmosphere and scaling on the holder base, and furnace radiation damage when there is an interruption of combustion air supply to the metallic flame holder. In order to overcome the above flame holder disadvantages several attempts have been made in the past. See, for example, U.S. Pat. No. 5,195,884 (Schwartz et al.), U.S. Pat. No. 5,667,376 (Robertson et al.), U.S. Pat. No. 5,957,682 (Kamal et al.) and U.S. Pat. No. 5,413,477 (Moreland). These devices use slight premix combustion or mixing recirculated flue gas (FGR) instead of using a flame holder device (for example, U.S. Pat. No. 6,027,330 (Lifshits)). However, the problems of flash back and limited flame stability range for premix burners (or for FGR burners) do not offer a complete solution in terms of extended stoichiometry, ease of operation, low cost operation and extremely fuel-lean operation (phi <0.1) required for achieving ultra low NOx (e.g., <5 ppmv) performance. The lack of flame stability is especially detrimental during the startup/heat-up of a process heater/furnace. In a cold furnace, burners with limited flame stability may experience blow-off of flame, thereby creating a hazard and delaying production. A remedy could be to use a second set of burners specially designed for heat-up conditions, which can be costly as well as manpower intensive.

BRIEF SUMMARY OF THE INVENTION

The present invention is directed to an ultra low NOx gaseous fuel burner for process heating applications such as utility boilers, process heaters and industrial furnaces. The novel burner utilizes two unique inter-dependent staged processes for generating a non-luminous, uniform and combustion space filling flame with extremely low (<9 ppmv) NOx emissions. This is accomplished using: (1) a flame stabilizer such as a large scale vortex device upstream to generate a low firing rate, well-mixed, low-temperature and highly fuel-lean (phi 0.05 to 0.3) flame for maintaining the overall flame stability, and (2) multiple uniformly spaced and diverging fuel lances downstream to inject balanced fuel in several turbulent jets inside the furnace space for creating massive internal flue gas recirculation. The resulting flame provides several beneficial characteristics such as no visible radiation, uniform heat transfer, lower flame temperatures, combustion space filling heat release and production of ultra low NOx emissions.

In the present invention, an ultra low NOx burner for process heating is provided which includes a fluid based flame stabilizer which provides a fuel-lean flame at an equivalence ratio in the range of phi=0.05 to phi=0.3 and fuel staging lances surrounding the flame stabilizer with each lance having a pipe having a staging nozzle at a firing end thereof, each lance having at least one hole for staging fuel injection, and each hole having a radial divergence angle and an axial divergence angle. The burner generates NOx emissions of less than 9 ppmv at near stoichiometry conditions.

In one embodiment, the at least one hole and the divergence angles are adapted to provide complete circumferential coverage of the fuel-lean flame. In another embodiment, the at least one hole and the divergence angles are adapted to provide a flat flame pattern. In a third embodiment, the at least one hole and the divergence angles are adapted to provide a load shaping flame pattern Preferably, between 4 and 16 staging lances are used and each staging nozzle has between 1 hole and 4 holes. Preferably the radial divergence angle is between 80 and 240 and the axial divergence angle is between 4° and 16°. The velocity of fuel exiting the nozzle is preferably between 300 to 900 feet per second for a natural gas staging fuel.

The distance from the forward end of the burner to a point where mixing of staging flame and flame stabilizer flame occurs is preferably approximately 8 to 48 inches. Finally, the fuel rate of the staging for natural gas fuel is from 70% to 95% of the total fuel firing rate of the burner.

The flame stabilizer is preferably a large scale vortex device where the flame has a peak flame temperature of less than approximately 2000° Fahrenheit. The equivalence ratio for the flame stabilizer is preferably in the range of phi=0.05 to phi=0.1.

The burner may include a burner block coaxial to the flame stabilizer. Preferably, the burner block is cylindrical or slightly conical, or rectangular in shape.

BRIEF DESCRIPTION OF SEVERAL VIEWS OF THE DRAWINGS

FIG. 11A through FIG. 11D are a schematic illustrations of various flat staging configurations of ultra low-NOx burners in accordance with the present invention tested in a lab furnace.

DETAILED DESCRIPTION OF THE INVENTION

Figure 1:
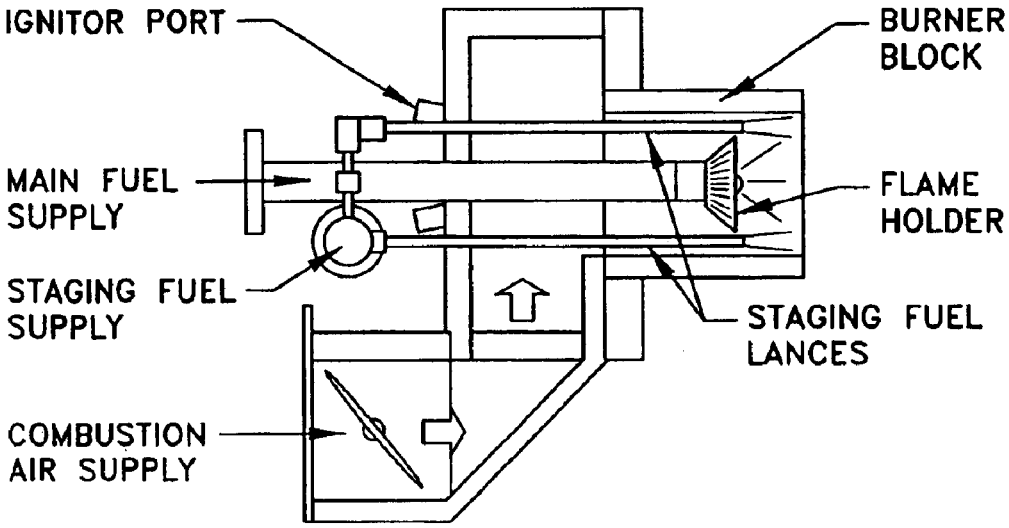
FIG. 1 (PRIOR ART)
FIG. 1 is a simplified side elevational view of a prior art air-fuel burner with a flame holder.
Figure 2:
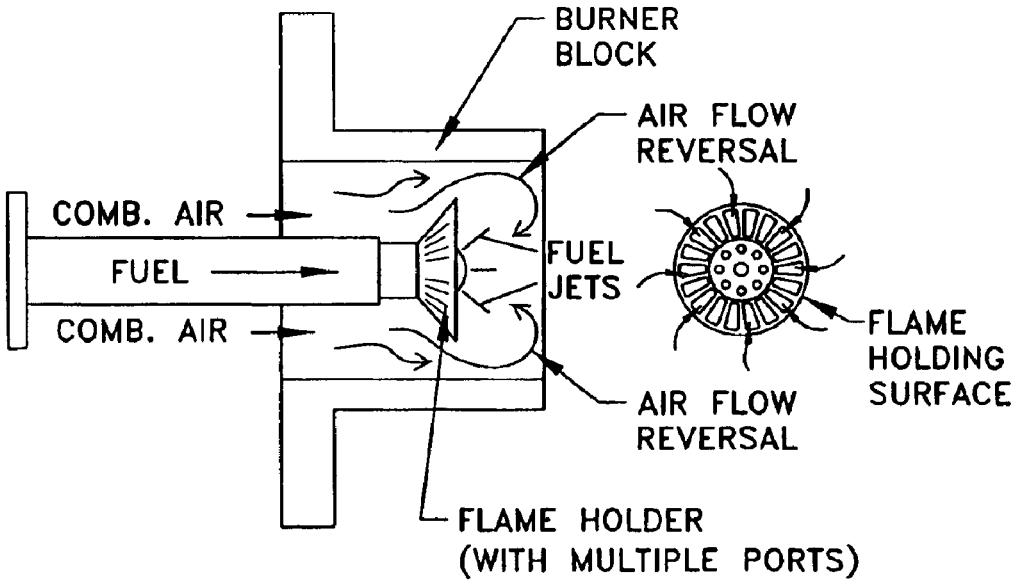
FIG. 2 (PRIOR ART)
FIG. 2 is a simplified side elevational view of a prior art flame holder for an air-fuel burner.
Figure 3:
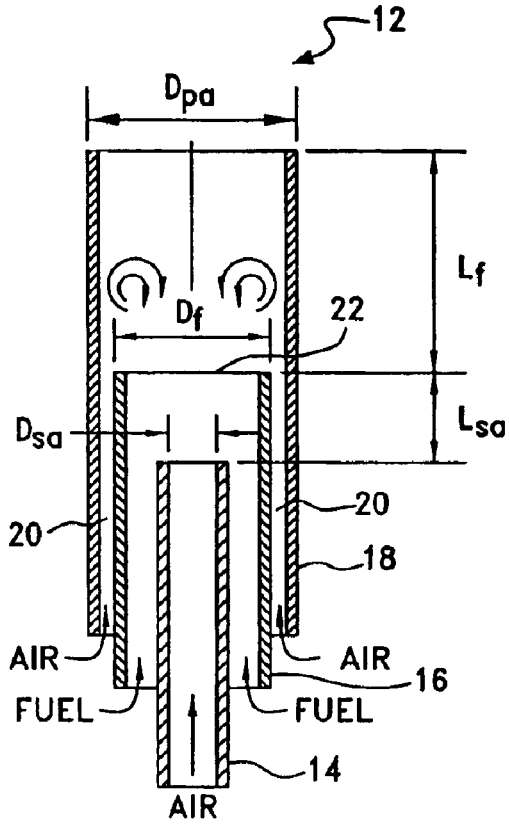
FIG. 3 is a simplified side elevational view of a fluid based large scale vortex flame stabilizer for use with an ultra low NOx burner of the present invention.

Referring now to the drawings, wherein like part numbers refer to like elements throughout the several views, there is shown in FIG. 3 a device for stabilization of a flame in the form of a large scale vortex (LSV) device 12 for use with an ultra low NOx burner 10 (see FIGS. 5A and 8) in accordance with the present invention. The LSV device 12 is comprised of an inner (secondary) air or oxidant pipe 14 recessed inside a fuel pipe 16, which is further recessed inside an outer (primary) air or oxidant pipe 18. The primary oxidant (e.g., air) is introduced axially at relatively high velocity and flow rate in the outer oxidant annulus 20 while the secondary oxidant (e.g., air) is directed through the secondary oxidant pipe 14 at a lower velocity and flow rate. Due to preferential high velocity combustion in the outer oxidant annulus 20 and much lower velocity through the secondary oxidant pipe 14, a pressure imbalance is developed around the secondary oxidant pipe 14. This causes a stream-wise vortex to develop downstream in the outer oxidant pipe 18, as shown in FIG. 3. Table I gives an example of specific velocity ranges and dimensionless ratios for obtaining a stable stream-wise vortex in the primary oxidant pipe 18. Here, $V_{pa}$=the velocity of the primary oxidant, $V_f$=the velocity of the fuel, $V_{sa}$=the velocity of the secondary oxidant, $D_f$=the diameter of the fuel pipe 16, $L_f$=the distance between the forward end of the fuel pipe 16 and the forward end of the primary oxidant pipe 18, $D_{pa}$=the diameter of the primary oxidant pipel 8, $L_{sa}$=the distance between the forward end of the secondary oxidant pipe 14 and the forward end of the fuel pipe 16, and $D_{sa}$=the diameter of the secondary oxidant pipe 14. The preferred average velocity ranges for fuel is about 2 to 6 ft/sec, for primary oxidant is 30 to 90 ft/sec and for secondary oxidant is 15 to 45 ft/sec.

TABLE 1

LSV Velocities and Dimensionless Ratio

| LSV Firing Rate MM | Velocity Range (ft./sec.) | | | Ratio | Ratio | Ratio |
|---|---|---|---|---|---|---|
| Btu/hr | $V_{pa}$ | $V_f$ | Vsa | $L_f/D_f$ | $L_f/D_{pa}$ | $L_{sa}/D_{sa}$ |
| 0.25 to 5 | 30–90 | 2–6 | 15–45 | 1 to 3 | 1 to 3 | 1 to 3 |

Figure 4A:
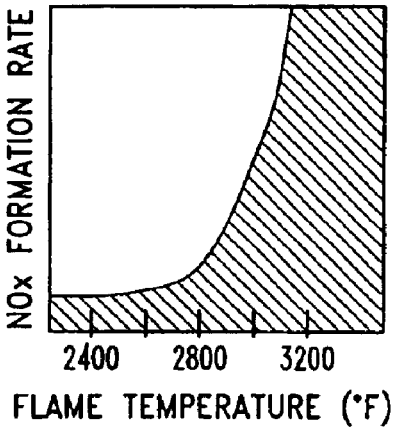
FIG. 4A is a graphical representation of NOx emissions vs. average flame temperature.
Figure 4B:
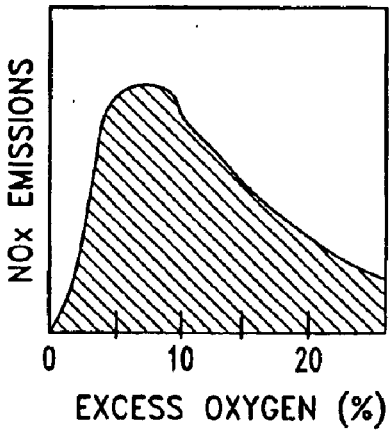
FIG. 4B is a graphical representation of NOx emissions vs. excess oxygen in exhaust gas.

The LSV device 12 is a fluid based flame stabilizer which can provide a very fuel-lean flame at an equivalence ratio as low as phi=0.05. At this ratio, the combustion air is almost 20 times more than the theoretically required airflow. The LSV flame stability is maintained at high excess airflow due to fluid flow reversal caused by a stream-wise vortex which, in turn, causes internal flue gas recirculation and provides preheating of air/fuel mixture and intense mixing of fuel, air and products of combustion to create ideal conditions for flame stability. The LSV flame is found to anchor on the fuel pipe tip 22, i.e., its forward end. Under normal operation, most LSV internal components remain at less than 1000° F. The operation of the LSV device 12 based on the stream-wise vortex principle makes it inherently more stable at a lower firing rate and at extremely low equivalence ratios. This is beneficial to lower peak flame temperatures. At a low firing rate and extremely fuel-lean stoichiometry, a flame with extremely low peak temperatures (less than 1600° F.) and NOx emissions less than 2 to 3 ppmv is produced. Lower NOx emissions associated with lower flame temperatures and extremely fuel-lean operation is clear. FIGS. 4A and 4B show general NOx trends as a function of flame temperature and excess oxygen measured in the exhaust gas.

The LSV device 12 operation at extremely fuel lean conditions for ultra low-NOx emissions necessitates that combustion of the remaining fuel downstream be accomplished in a strategic manner to complete combustion, to avoid additional NO or CO formation, and to operate the burner system with a slight overall excess of oxygen (2 to 3%) in the exhaust.

Figure 5A:
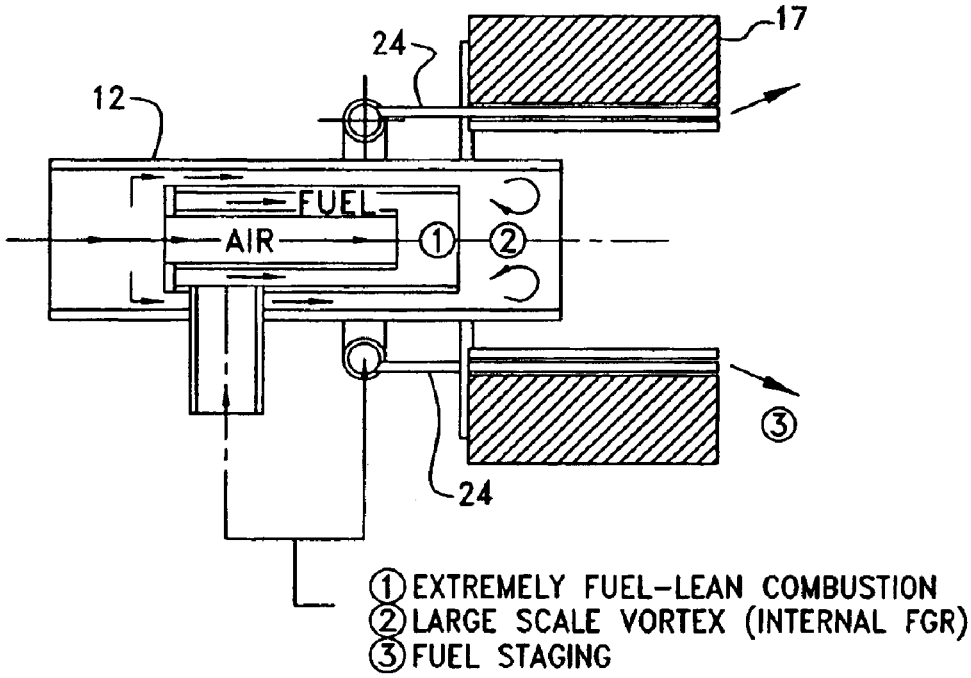
FIG. 5A is a simplified, side elevational view of an ultra low-NOx burner in a circular staging configuration in accordance with the present invention.

FIG. 5A shows a schematic of the ultra low-NOx burner 10 in accordance with the present invention which combines the aforementioned LSV device 12 with strategic fuel staging lances 24 in a circular configuration. The overall burner process can be described in three process elements: 1) extremely fuel-lean combustion, 2) large scale vortex for flame stability, and 3) fuel staging using strategically located fuel lances 24. As shown in FIG. 5A, the LSV device 12 is surrounded in a cage type construction using multiple fuel staging lances 24. The lances 24 are long steel pipes with specially designed staging nozzles 26 at the firing end. According to lab experiments, the optimum number of staging lances 24 can vary from 4 to 16 and each staging lance 24 has multiple diverging holes 28 (see FIGS. 7A, 7B, and 7C, as described below) for staging fuel injection. The number of holes 28 per staging nozzle 26 can vary from a single hole for a less than 1 MM Btu/hr burner to, for example, 4 holes for higher firing rate burners. The number of staging holes 28 and their divergence angles (alpha and beta as described below) are chosen to accomplish complete circumferential coverage of the LSV flame for a circular configuration (see FIG. 5A), a flat configuration (see FIGS. 5B and 5C) or to accomplish a load shaping pattern (see FIGS. 12A and 12B).

Figure 6:
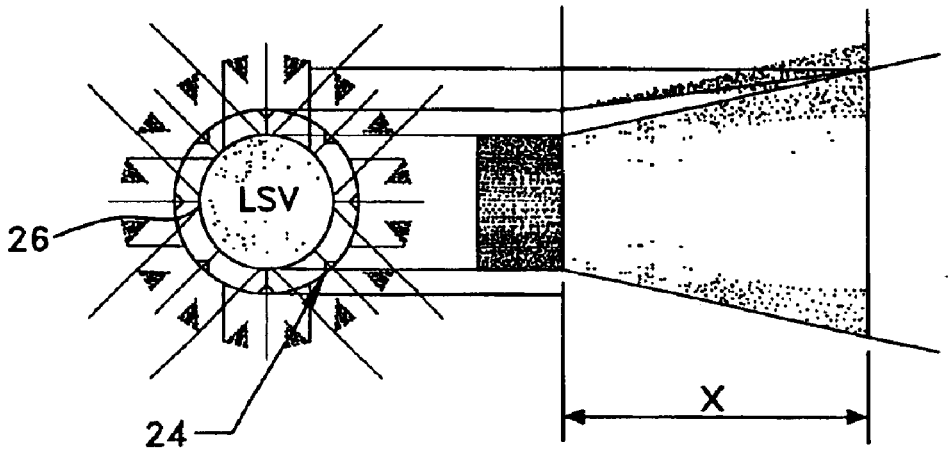
FIG. 6 is a simplified front and side view of fuel nozzles and flame pattern of the flame stabilizer of FIG. 3 in combination with the ultra low-NOx burner of FIG. 5A.
Figure 7A:
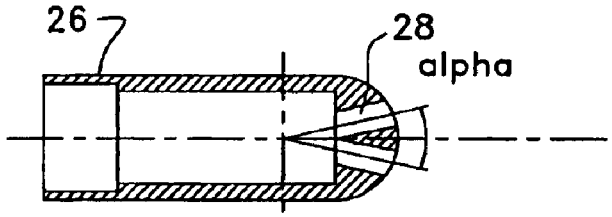
FIG. 7A is a cross-sectional, top plan view of a fuel staging nozzle used in the burner of FIG. 5A.
Figure 7B:
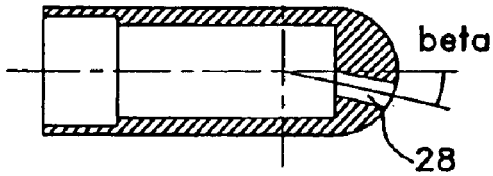
FIG. 7B is a cross-sectional, side elevational view of the fuel staging nozzle of FIG. 7A.
Figure 7C:
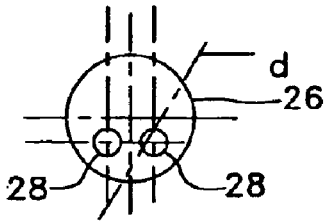
FIG. 7C is a right side view of the fuel staging nozzle of FIG. 7B.

FIG. 6 shows a schematic for a 4 MM Btulhr burner with a 10 inch diameter burner block. Eight uniformly distributed staging fuel lances 24 (on a 7 inch pitch circle radius) and two diverging holes per staging lance provide a circular pattern. FIGS. 7A, 7B and 7C show one typical design of staging lance nozzle 26 and geometry of staging holes 28 (note angles alpha and beta).

The holes 28 are drilled at a compound angle with respect to two orthogonal axes. The objective is to distribute staging fuel uniformly over the fuel-lean LSV flame envelope. FIG. 6 shows how a two-hole nozzle 24 installed on eight uniformly placed lances of the above example, having a radial divergence angle alpha=7° and axial divergence angle beta=15° can surround the LSV flame completely at a distance of X=24 inches. This intersection or merge distance, X, (see FIG. 6) has been verified during laboratory firing. The complete envelope of staging fuel that is significantly diluted with combustion gases produces a very low temperature and combustion space filling flame. The preferred range for angle alpha is between 8° and 24° and for angle beta is between 4° and 16°. The holes 28 vary in size depending on staging fuel injection velocity range. The preferred nozzle exit velocity range is between 300 to 900 feet per second for natural gas staging fuel. For a single hole staging nozzle, preferably, only an axial divergence angle alpha is used. The above velocities (or nozzle hole sizes) vary depending on the fuel composition (and heating value) and burner firing capacity.

Figure 8:
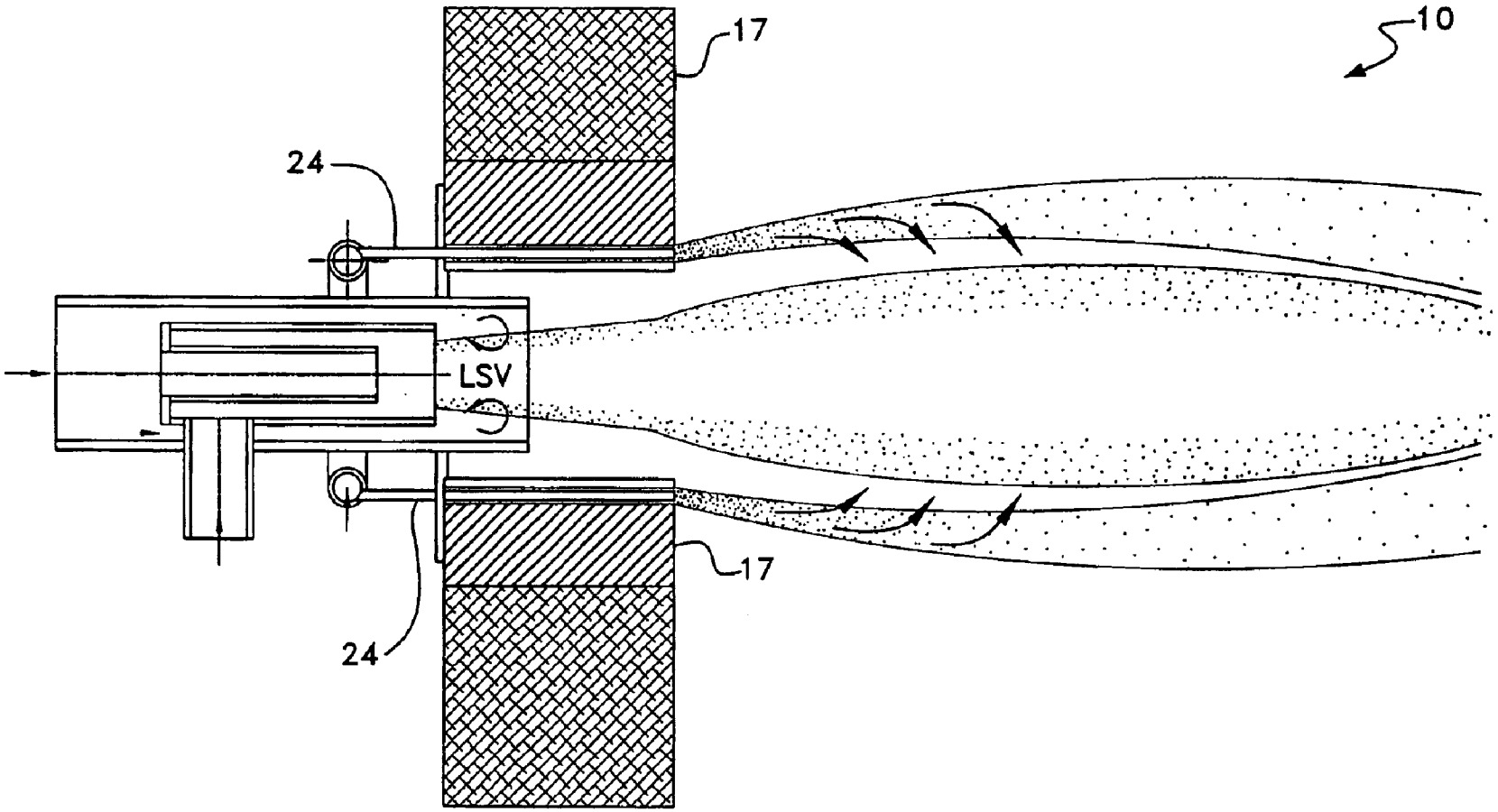
FIG. 8 is a simplified side elevational view of the burner of FIG. 5A depicting interaction of a flame stabilizer fuel flame and a staging fuel flame.

The complete ultra low NOx burner with LSV flame upstream and fuel staging downstream is illustrated in FIG. 8. The various combustion processes are also shown. Referring to FIG. 8, the various burner flame processes are now described:

LSV Flame

The LSV flame is maintained extremely fuel-lean (e.g., phi=0.05) and is anchored on the LSV fuel pipe 16. This flame gets more stable as the primary airflow through the relatively narrow outer oxidant annulus 20 is increased. The LSV flame has a very low peak flame temperature (less than ~2000° Fahrenheit) and produces very low NOx emissions. This is due to excellent mixing, avoidance of fuel-rich zones for prompt NOx formation (as observed in traditional flame holders) and completion of overall combustion under extremely fuel-lean conditions. The recycling of exhaust gas in the LSV device 12 also reduces flame temperature due to product gas dilution. Table II gives laboratory firing data on the LSV device 12 under fuel lean firing conditions. Here, it is clear that the LSV device 12 produces very low NOx emissions at low firing rates and under extremely fuel-lean conditions. Note that high oxygen concentration and low $CO_2$ concentration indicate excess air operation accompanied by leakage of outside are through refractory cracks in the lab furnace.

TABLE II

LSV lab firing data; LSV Firing Only, Furnace between 1000° and 1500° Fahrenheit

| LSV Firing | Comb. Air | emissions (dry) | | | | Corrected | Corrected | Corrected |
|---|---|---|---|---|---|---|---|---|
| Rate (MM Btu/hr) | Theo. (%) | $O_2$ (%) | CO (ppm) | $CO_2$ (%) | NO (ppm) | NO @ 3% $O_2$ (ppmv) | NO @ 3% $O_2$ (lb/MM Btu) | NO @ 3% $O_2$ (mg/Nm$_3$) |
| 0.5 | 550 | 17.6 | 0.25 | 0.18 | 0.4 | 2.1 | 0.003 | 4.3 |
| 1 | 450 | 18.3 | 0.25 | 0.27 | 0.5 | 3.3 | 0.004 | 6.8 |
| 2 | 255 | 15.6 | 2.4 | 0.73 | 1.8 | 6.0 | 0.008 | 12.3 |

In addition, there are important observations regarding the LSV flame. The LSV device 12 is generally fired at equivalence rations of 0.05 to 0.1. For example, if there is a total firing rate of 4 MM Btu/hr, the LSV device 12 is firing at 0.4 MM Btu/hr, and fuel staging lances 24 are set to inject fuel at 3.6 MM Btu/hr, the LSV device 12 will then supply total combustion air for 4 MM Btu/hr or air at a 900% level for 0.4 MM Btu/hr firing rate. At this condition, the LSV flame is extremely fuel-lean, it is diluted with combustion air, and products of combustion from vortex action and the resulting peak flame temperature (as measured by a thermocouple probe before staging fuel jets meet the LSV flame) are less than 2000° Fahrenheit.

As can be seen in FIG. 6, the merge distance, X, between the LSV flame and the staging jets from the furnace wall is maintained at approximately 8 to 48 inches from the end of the burner and this distance depends on the burner-firing rate and staging fuel divergence angle (beta). For a 4 MM Btu/hr total firing rate, a measured merge distance was approximately 24". This distance is critical in keeping the flame free from visible radiation, providing combustion space filling characteristics, having low peak flame temperatures, and producing ultra low NOx emissions.

The dilution of combustion air using LSV products of combustion is also very important for reducing localized oxygen availability. For example, if 36,000 scfh of combustion air (at ambient temperature) is mixed with approximately 1500° F. products of combustion from an LSV device 12 firing at 0.40 MM Btu/hr firing rate, there is a localized dilution of combustion air. Additionally, oxygen concentration in the combustion air decreases from about 21% to 19%. This reduction in oxygen availability (which may be higher locally due to volumetric gas expansion) can reduce NOx emissions further when already diluted staging fuel reacts with the preheated air of reduced oxygen concentration. This dual effect of fuel dilution and air dilution are explained below under Circular Staging configuration.

Peak temperatures of the spacious flame occur outside the center core region of overall flame. The temperature profile is a reflection of circular staging pattern and lower temperatures exist in the core region due to fuel-lean LSV products of combustion. During laboratory measurements (at furnace temperature of 1600°), at 4 MM Btu/hr firing capacity, the peak flame temperatures never exceeded 2100° Fahrenheit at any transverse cross section along furnace length.

Circular Staging

As shown in FIG. 8, the fuel staging is performed using a circular staging configuration with multiple diverging lances 24 installed around the LSV device 12 or the burner block 17 exterior. The fuel jets are injected in the furnace space using nozzles 26 of specific hole geometry. See FIGS. 7A, 7B, and 7C.

In this method of fuel staging, the resulting combustion (above auto ignition temperature) is controlled by chemical kinetics and by fuel jet mixing with the furnace gases and oxidant. The carbon contained in the fuel molecule is drawn to complete oxidation with the diluted oxidant stream instead of the pyrolitic soot forming reactions of a traditional flame front. It is assumed here that combustion takes place in two stages. In the first stage, fuel is converted to CO and $H_2$ in diluted, fuel rich conditions. Here, the dilution suppresses the peak flame temperatures and formation of soot species, which would otherwise produce a luminous flame. In the second stage, CO and $H_2$ react with diluted oxidant downstream to complete combustion and form $CO_2$ and $H_2O$. This space-based dilution and staged combustion leads to a space filling process where a much larger space surrounding flame is utilized to complete the overall combustion process.

In order to illustrate the effects of fuel jet dilution, the theoretical natural gas jet entrainment calculations are presented in Table Ill. Here, a free turbulent gas jet at 579 feet per second velocity is injected inside a still furnace environment maintained at 2000° Fahrenheit. The fuel jet continues to entrain furnace gases along the firing axis until it reaches the entrainment limit. For example, at two feet axial distance, the jet entrained 24 times its mass and the average fuel concentration per unit volume is reduced to less than 5%.

TABLE III

NG jet entrainment in the furnace atmosphere

| mNG (scfh) | Ce | x (ft) | do (inch) | NG jet $V_o$ (ft /sec) | Fu. Temp (° F.) | Rho NG (lbm/ $ft^3$) | Rho fu gas (lbm/$ft^3$) | Entrain-ment Ratio | Jet mass @ x (scfh) | Average NG Con-centration |
|---|---|---|---|---|---|---|---|---|---|---|
| 400 | 0.32 | 0.5 | 0.188 | 579 | 2000 | 0.0448 | 0.015614 | 6 | 2,418 | 0.165418 |
| | | 1 | | | | | | 12 | 4,836 | 0.082709 |
| | | 1.5 | | | | | | 18 | 7,254 | 0.055139 |
| | | 2 | | | | | | 24 | 9,671 | 0.041354 |
| | | 3 | | | | | | 36 | 14,509 | 0.02757 |

Thus, in this case, a fuel jet significantly diluted (with $N_2$, $CO_2$ and $H_2O$) using furnace gas entrainment can readily react with furnace-oxidant to form a combustion space filling low-temperature flame. The Handbook of Combustion, Vol. 11, illustrates lower NOx formation under diluted conditions as shown in FIG. 9.

Figure 9:
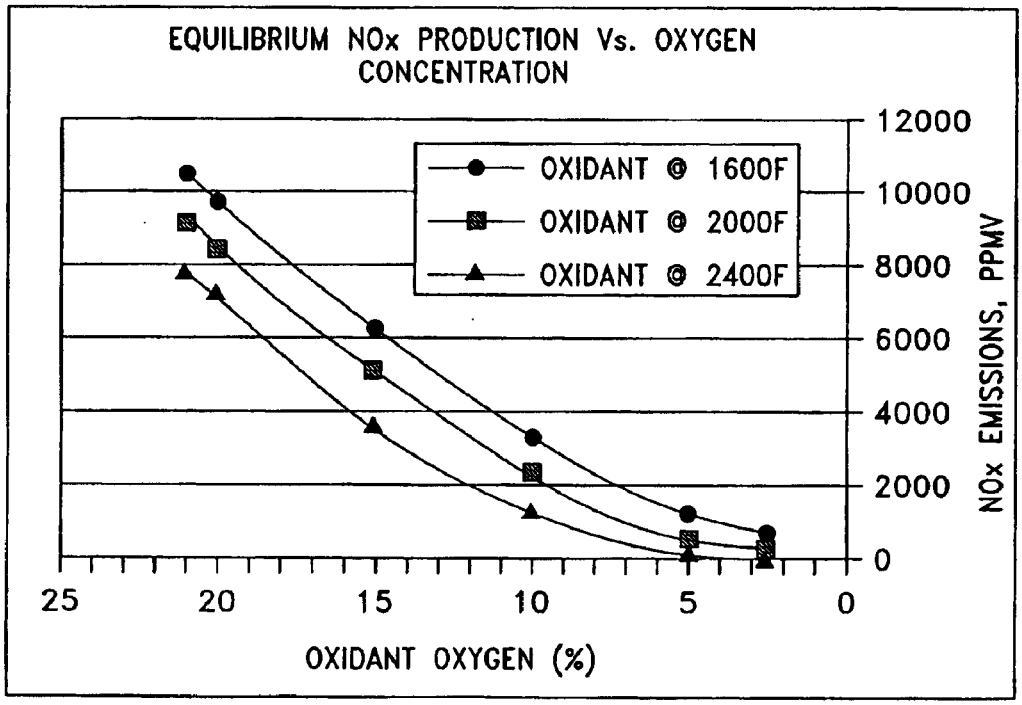
FIG. 9 is a is a graphical representation of NOx emissions with respect to oxidant/oxygen under diluted conditions.

In FIG. 9, it is shown that the oxygen available under diluted conditions for NOx formation is further curtailed if oxidant is preheated to higher preheat temperatures. In the present case, the LSV device 12 supplies a preheated oxidant stream, which is also diluted in oxygen concentration due to mixing with it own products of combustion.

The amount of fuel staging (for natural gas fuel) can be anywhere from 70% to 95% of the total firing rate of the burner. This range provides extremely low NOx emissions (1 to 9 ppmv). Fuel staging range less than 70% can be used for spacious combustion if NOx emissions are not of concern. The fuel staging range above 95% can be used for gases containing hydrogen, CO or other highly flammable gases.

Figure 10:
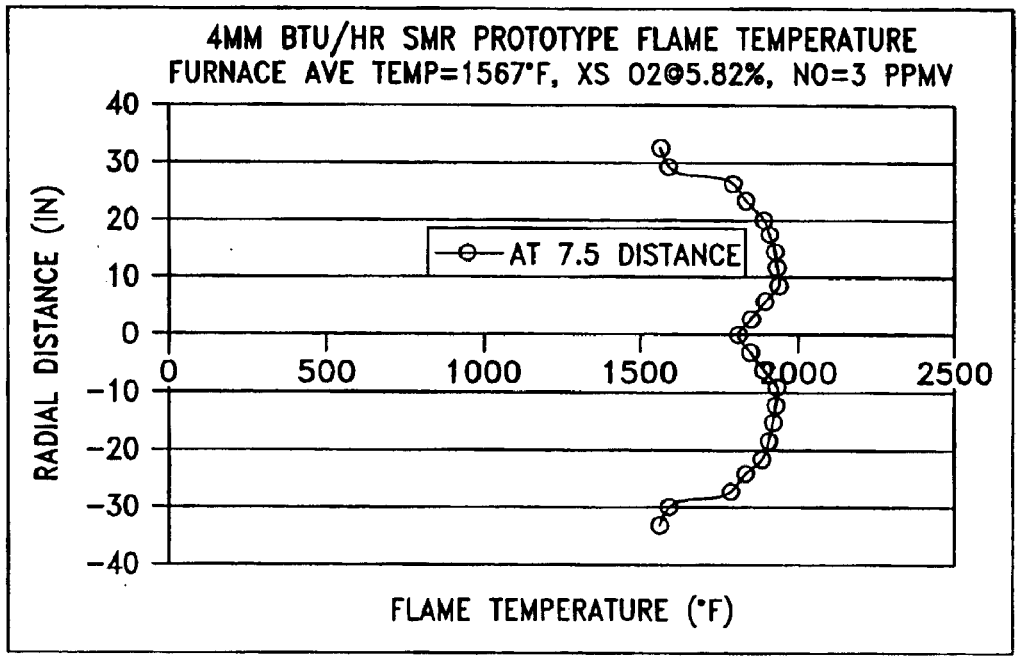
FIG. 10 is a graphical representation of lab measurements of a burner flame using a suction pyrometer depicting flame temperature vs. radial distance.

The combined effect of the above two dilution processes, (1) fuel jet dilution using strategic staging and (2) oxidant dilution using LSV, is to reduce peak flame temperatures, reduce NOx emissions and create a combustion space filling combustion process. Further evidence of low peak flame temperatures was obtained by direct flame gas temperature measurement using a suction pyrometer probe in the laboratory furnace. As shown in FIG. 10, at 4 MM Btu/hr total firing rate (LSV firing at 0.4 MM Btulhr and fuel staging at 3600 scfh), furnace average temperature of approximately 1600° Fahrenheit, and under combustion space filling flame conditions, there is a radial temperature profile consisting of peak temperatures less than 2000° Fahrenheit at an axial distance of 7.5 feet from the burner exit plane. The emissions results in the laboratory furnace are illustrated in Table IV at various firing rates.

TABLE IV

Overall burner emissions in laboratory furnace
LSV + Fuel Staging Data, Furnace @ ~ 1500° Fahrenheit

| LSV Firing Rate (MM Btu/hr) | Fuel Staging Firing Rate (MM Btu/hr) | Total Firing Rate (MM Btu/hr) | Emissions (dry) $O_2$ (%) | CO (ppm) | $CO_2$ (%) | NO (ppm) | Corrected NO @ 3% $O_2$ (ppmv) | Corrected NO @ 3% $O_2$ (lb/ MM Btu) | Corrected NO @ 3% $O_2$ (mg/ $Nm^3$) |
|---|---|---|---|---|---|---|---|---|---|
| 0.5 | 0.75 | 1.25 | 6.6 | 8 | 7.15 | 2.7 | 3.4 | 0.005 | 6.9 |
| 0.75 | 0.75 | 1.5 | 5.5 | 9.3 | 7.93 | 3.8 | 4.4 | 0.006 | 9.0 |
| 0.75 | 1.25 | 2 | 3.9 | 7.4 | 8.85 | 3.5 | 3.7 | 0.005 | 7.6 |
| 0.5 | 2.5 | 3 | 2.9 | 22 | 9.54 | 0.9 | 0.9 | 0.001 | 1.8 |
| 0.75 | 3.25 | 4 | 2 | 36 | 9.9 | 1.9 | 1.8 | 0.002 | 3.7 |
| 0.8 | 4.2 | 5 | 1.68 | 21 | 10.2 | 2.67 | 2.5 | 0.003 | 5.1 |
| 0.8 | 5.2 | 6 | 2.28 | 27 | 9.82 | 1.74 | 1.7 | 0.002 | 3.4 |

The data in Table IV indicate that overall NOx emissions are less than 5 ppmv (corrected at 3% excess oxygen) for 1 to 6 MM Btu/hr firing capacity. The flame was completely non-luminous and combustion space filling between 2 to 6 MM Btu/hr firing capacity. The fuel staging lances (8 total) used a similar geometry fuel nozzle (as shown in FIG. 7 with two holes) with radial divergence angle alpha=15° and an axiall divergence angle beta=7°. The fuel staging hole diameter for above tests was 0.11 inches. This provided an average natural gas injection velocity of 300 to 900 feet per second in the firing range of 2 to 6 MM Btu/hr. The burner also used less than 1.5 inches of water column pressure drop for the combustion air in the LSV device.

The preferred construction of the ultra low NOx burner uses concentric standard steel pipes or standard tubes welded in a telescopic fashion to satisfy the key LSV flow, velocity and dimensionless ratios (see above). For example, a 4 MM Btu/hr. nominal firing rate LSV device 12 may be built using standard 3 inch Schedule 40 pipe for the secondary oxidant pipe 14, a 6 inch Schedule 40 pipe for the fuel pipe 16, and an 8 inch Schedule 40 pipe for the primary oxidant pipe. The burner block 17 (see FIG. 8) may be built using standard 10 inch Schedule 40 pipe. The lances 24 may be ½ inch schedule 40 pipe with nozzles 26 welded or threaded thereon. These pipes may be made from, for example, carbon steel, aluminized steel, stainless steel, or high temperature alloy steels.

As indicated above, the cylindrical burner block 17 for the LSV flame is sized using a standard pipe size. The burner block 17 may be sized one or two pipe sizes larger than the primary oxidant pipe 18 in the LSV device 12. For example, as indicated above, for a 4 MM Btu/hr nominal capacity burner, the primary oxidant pipe 18 may be an 8 inch Schedule 10 pipe. Thus, the burner block was selected as 10 inch 40 pipe (one standard pipe size larger). The burner block 17 length is generally the same as the furnace wall thickness (e.g., about 12" to 14"). The design objective of the cylindrical burner block is to avoid LSV flame interference on the inside surface of the burner block, keeping burner block material cool (preventing thermal damage), and reducing the frictional pressure drop for the incoming combustion air. The burner block cavity is preferred to be cylindrical or slightly conical (half cone angle less than 10°) in shape for several reasons. First, any staging fuel infiltration (back flow) into the burner block cavity is avoided. For large conically divergent blocks, it is very likely that the staging fuel may enter the low-pressure recirculation region inside burner block cavity to initiate premature combustion and overheating. Second, LSV flame envelope symmetry is maintained with corresponding fuel staging geometry in circular staging configuration. Finally, LSV flame momentum is fully maintained to create a stronger large scale vortex and to create delayed mixing with diluted fuel jets.

Flat Staging

Figures 5B, 5C:
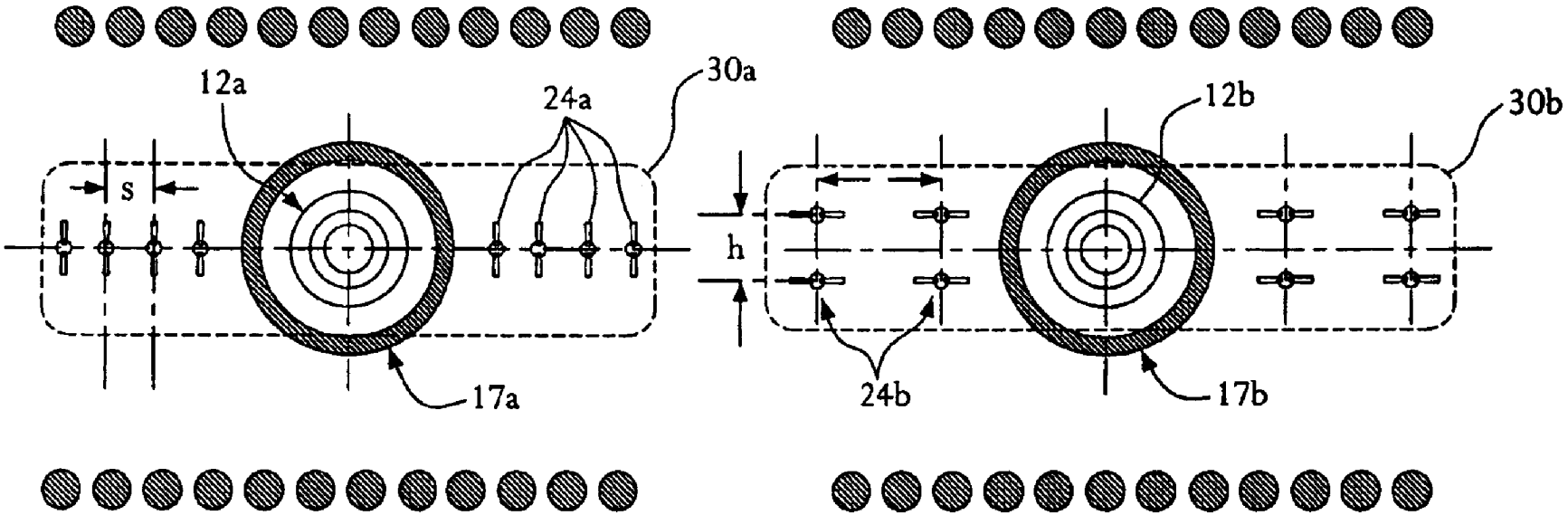
FIG. 5B is a simplified, front firing, end view of an ultra low-NOx burner in a flat staging configuration in accordance with the present invention.
FIG. 5C is a simplified, front firing, end view of an ultra low-NOx burner in another flat staging configuration in accordance with the present invention.

Other staging configurations also operate acceptably well in accordance with the present invention. For example, additional fuel staging experiments were carried out for flat staging configurations. Schematic diagrams of flat staging configurations are shown in FIGS. 5B and 5C. Here the staging lances 24*a*, 24*b* are placed in a linear fashion on both left and right sides of an LSV device 12*a*, 12*b*. Also shown are burner blocks 17*a* (FIG. 5B), 17*b* (FIG. 5C). The flame envelopes 30*a*, 30*b*, are shown in dotted lines. The separation distances "s" (see FIG. 5B) and "h" (see FIG. 5C) were determined experimentally based on NOx reduction and least amount of CO formation. The optimum distance based on burner firing range lie between 2 and 12 inches. FIGS. 11A through 11D show several flat staging configurations for 4 MM Btu/Hr total firing rate and approximately 1500° F. average furnace operating temperature. The LSV devices 12*c*, 12*d*, 12*e*, 12*f* were fired at 0.5 MM Btu/Hr whereas fuel lances 24*c*, 24*d*, 24*e*, 24*f* were set at 3.5 MM Btu/Hr firing rate and at a separation distance of s=4.66". The lances 24, 24*d*, 24*e*, 24*f* were of various holes sizes, number of holes, and various radial and axial divergence angles. These values are noted in FIGS. 11A through 11D. The lance locations and hole geometry was varied to understand the effect on staging fuel supply pressure as well as emissions of NO and CO. It was noticed that higher staging fuel supply pressure produced lower NOx emissions and vice-versa. The emission results indicated less than 6 ppmv NO emissions and low CO emissions (<50 ppmv) at fuel supply pressure between 2 and 5 psig.

Some hydrogen furnaces, in particular, reformers, which are direct-fired chemical reactors consisting of numerous tubes located in the furnace (firebox) and filled with catalyst. Conversion of hydrocarbon and steam to an equilibrium mixture of hydrogen, carbon oxides and residual methane takes place inside the catalyst tubes. Heat for the highly endothermic reaction is provided by burners in the firebox. A Large Steam Methane Reformer (SMR) is usually of a top fired design. Top fired reformers have multiple rows of tubes in the firebox. The burners, for example, as many as 150, are located in an arch on each side of the tubes and heat is transferred to the tubes by radiation from the products of combustion. A burner utilizing flat staging would be ideal for top-fired SMR furnaces.

Load Shaping Staging

In a third embodiment, the ultra low NOx burner is configured in the shape identical to load geometry. Here, single or multiple LSV devices 12*g*, which provide a fuel-lean flame at an equivalence ratio in the range of phi=0.05 to phi=0.3, and fuel staging lances are placed strategically inside the furnace so as to cover entire load surface area with staging lances 24*g*. Each lance 24*g* has a pipe having a fuel staging nozzle at a firing end thereof and having at least one hole at end for staging fuel injection, as described above for the previous embodiments. Each hole has a radial divergence angle and an axial divergence angle, as described above for the previous embodiments. The hole or holes and the divergence angles provide a load shape coverage. The burner in this configuration also provides NOx emissions of less than 9 ppmv.

The above concept can be explained by considering a typical industrial packaged boiler. Many boilers of this kind (e.g., a D-type boiler) have the ability to totally water cool the furnace front, sidewalls, floor and rear walls using water-tubes or load surface. This construction eliminates the need for refractory walls for furnace construction and high temperature seals. The design provides a totally water-cooled welded furnace envelope for combustion to take place. The additional heat transfer surface areas create lower NOx emissions and provide higher thermal efficiency.

Figure 12A:
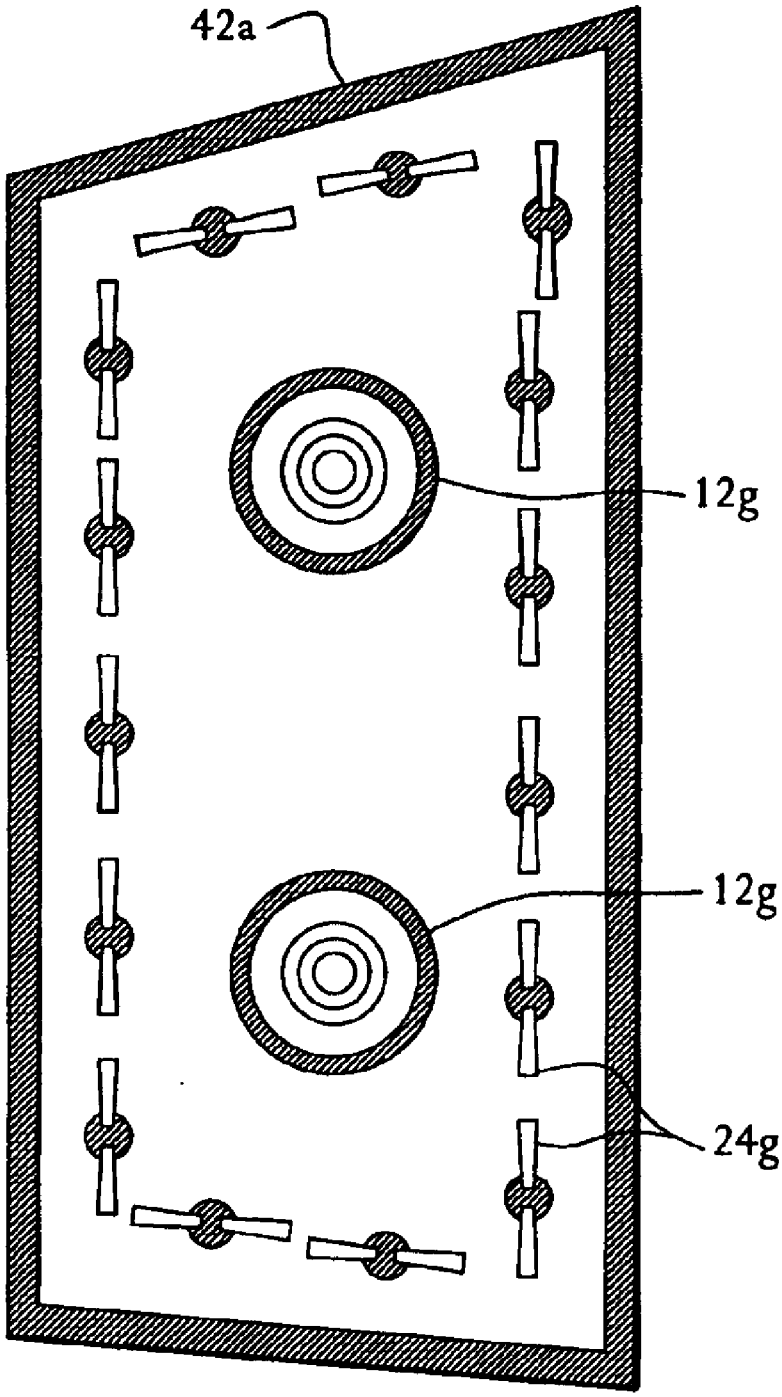
FIG. 12A is a simplified illustration of a load shaping staging configuration in an industrial boiler using multiple flame stabilizers.
Figure 12B:
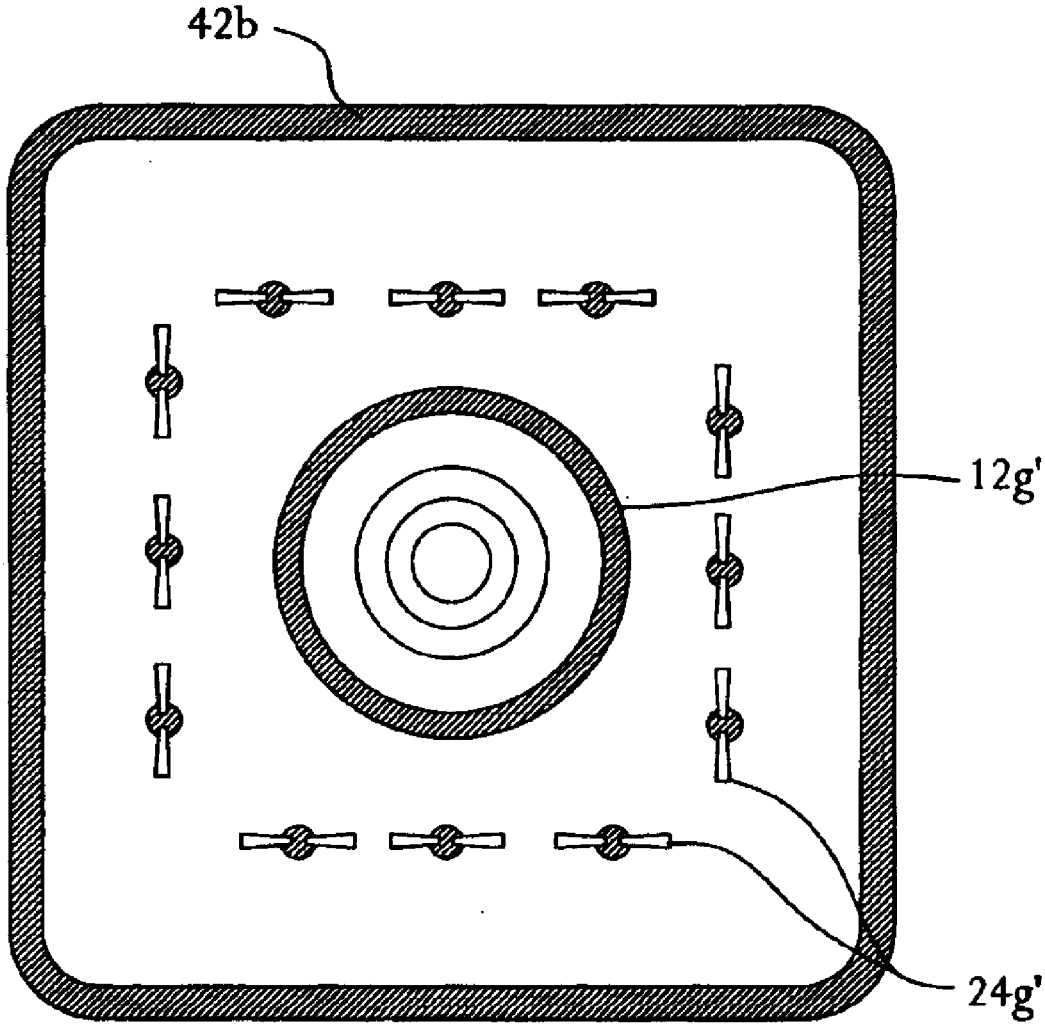
FIG. 12B is a simplified illustration of a load shaping staging configuration in an industrial boiler using a single flame stabilizer.

As shown in FIGS. 12A and 12B, single or multiple LSV devices 12*g*, 12*g*' are used and fuel staging lances 24*g*, 24*g*' are strategically placed parallel to load, such as boiler water tube envelope surface 42*a*, 42*b*, geometry (square, rectangle, trapezoidal, circular, elliptical or any other load shape by combination of various primary shapes). The objective of above staging strategy is to entrain relatively cooler furnace gases in the vicinity of load surface (e.g. water or process tubes) and create a low-temperature overall spacious flame.

Again, preferably, between 4 and 16 staging lances 24*g*, 24*g*' are used per LSV device 12*g* and each staging nozzle has between 1 hole and 4 holes. The lances 24*g*, 24*g*' can be configured parallel to the load geometry and can be positioned in several parallel rows. Preferably the radial divergence angle is between 8° and 24° and the axial divergence angle is between 0° and 16°. The velocity of fuel exiting the nozzle is preferably between 300 to 900 feet per second for a natural gas staging fuel.

Figure 13A:
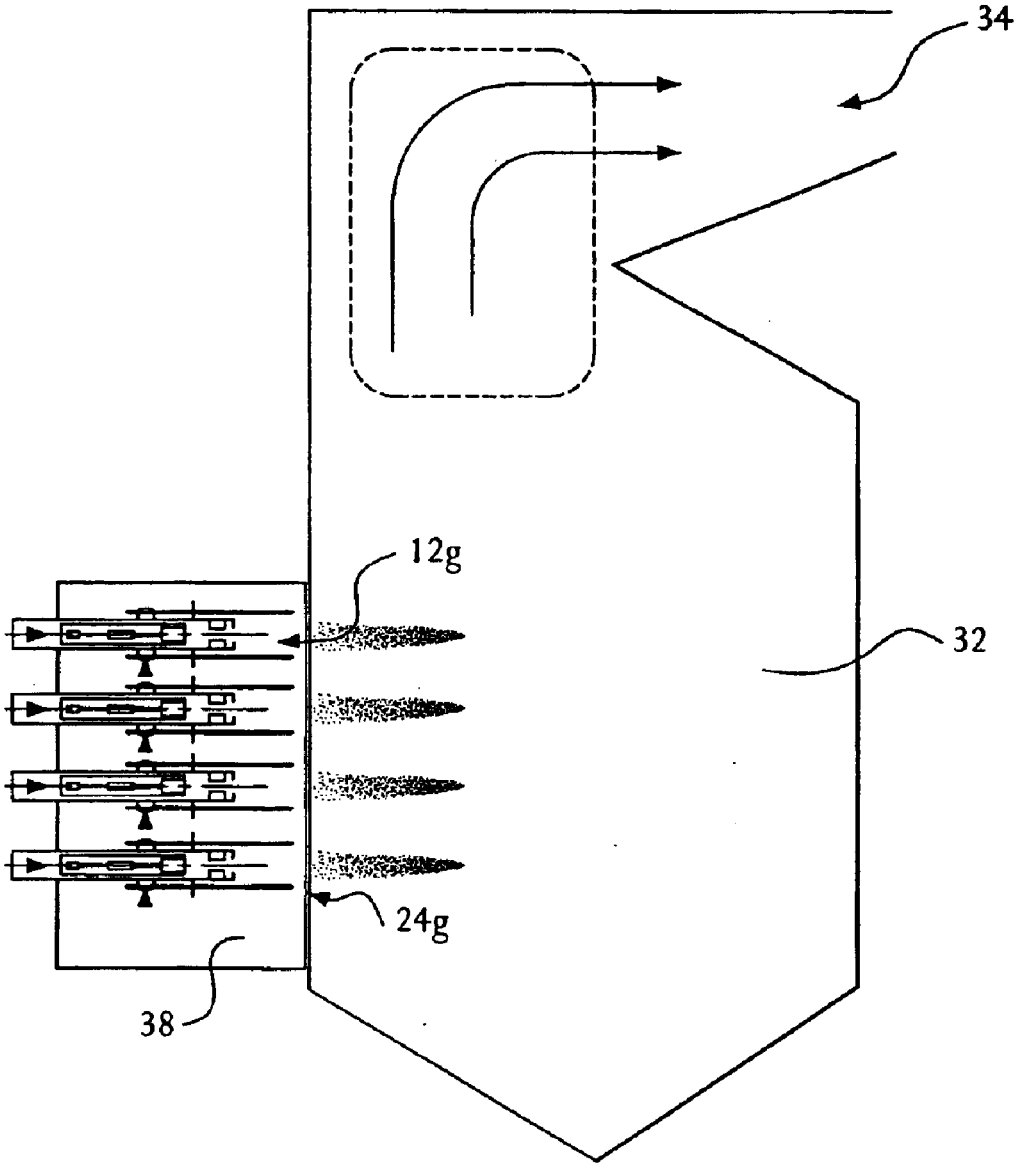
FIG. 13A is a simplified illustration of a wall-fired power boiler firing configuration with rows of stabilizers and fuel staging lances.
Figure 13B:
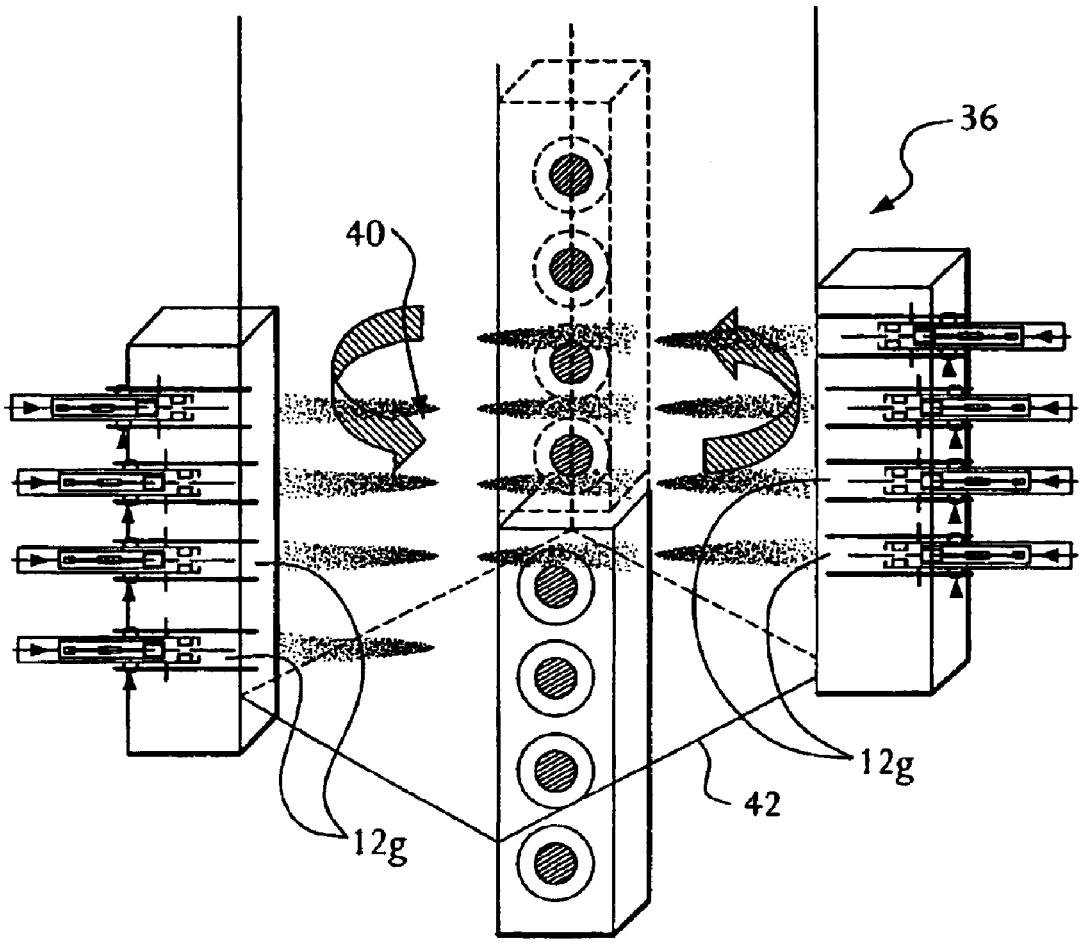
FIG. 13B is a simplified illustration of a tangential-fired power boiler firing configuration with rows of stabilizers and fuel staging lances.

For power or utility boilers, the load shaping staging can be implemented using either wall fired firing boiler 34 configuration, see FIG. 13A or tangentially fired firing configuration 36. see FIG. 13B. Most power boilers are much larger in capacity and use anywhere from 10 to 20 burners per firing wall and typical firing capacity is about 1 billion Btu/hr. As shown in FIG. 13A, the burners are placed in several rows and they share common manifold 38 for combustion air. The low NOx burners 12*g* can be placed in similar geometrical locations and share common combustion air supply through a rectangular air manifold 38. The most important design aspect for achieving low NOx emissions would be to use multiple fuel lances 24*g* on the firing wall in several rows between LSV devices 12*g* to create spacious flame 32. Furnaces gases are entrained in the staged fuel jets before combusting with combustion air discharged from LSV device 12*g*. Unlike smaller industrial boilers, the power boilers have refractory line combustion chamber or radiation zone where most of the fuel is combusted and then hot products of combustion travel upward to heat water-tubes or load in the convection zone, and then economizer section before discharged out to the stack. In most boilers, over-fired air (portion of combustion air 5 to 25%) is injected just after radiation zone for reducing NOx emissions.

FIG. 13B shows tangentially-fired power boiler, where all four corners are used to create a swirling or tangential flow pattern 40 inside a square furnace radiation zone 42. The combustion air supplied by air registers and the proposed low NOx burners are mounted in several rows on all four corners. The load shaping fuel lances 12*g* can be installed in several rows between LSV devices 12*g* to create a tangential or swirling spacious flame. By injecting fuel separately from combustion air and not directly mixing it with combustion air, the availability of oxygen for NOx formation is minimized and it also enables fuel jets to get diluted using furnace gases for entrainment. The resulting flame is spacious and it has extremely low flame temperatures and NOx emissions.

Again, preferably, between 4 and 16 staging lances are used per LSV device 12 and each staging nozzle has between 1 hole and 4 holes. The lances can be configured parallel to the load geometry and can be positioned in several parallel rows. Preferably the radial divergence angle is between 8° and 24° and the axial divergence angle is between 0° and 16°. The velocity of fuel exiting the nozzle is preferably between 300 to 900 feet per second for a natural gas staging fuel.

In large utility boilers, multiple burners, for example, 20 to thirty burners, are fired on opposite walls or in tangential configuration and heat from burner firing is used for generating steam. These are large boiler units with capacities greater than 250 MM Btu/Hr. However; typical industrial boilers are smaller in physical size they have packaged (D-Type) or modular construction. The burner flame is totally enclosed in a gastight water-cooled tube or load envelope. The use of "load shaping" lances would be ideal for industrial boilers. These are used for generating process steam used in refinery or chemical industry. The firing capacity is between 50 and 250 MMBtu/Hr.

It is noted that, for purposes of the present invention, an oxidant with an oxygen concentration between 10 and 21% may be used or an enriched oxidant, i.e., greater than 21% and less than 50% oxygen content may be used. Preferably, the oxidant is at ambient conditions to a preheated level, for example, 200 degrees F. to 2400 degrees F.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. An ultra low NOx burner for process heating, comprising:

a) a fluid based flame stabilizer which can provide a fuel-lean flame at equivalence ratio in the range of phi=0.05 to phi=0.3; and b) a plurality of fuel staging lances surrounding said flame stabilizer, each said lance comprising a pipe having a staging nozzle at a firing end thereof, each lance having at least one hole for staging fuel injection, each hole having a radial divergence angle and an axial divergence angle wherein said at least one hole and said divergence angles are adapted to provide complete circumferential coverage of the fuel-lean flame;

whereby NOx emissions of less than 9 ppmv are generated at near stoichiometry conditions.

2. An ultra low NOx burner for process heating, comprising:

a) a fluid based flame stabilizer which can provide a fuel-lean flame at equivalence ratio in the range of phi=0.05 to phi=0.3; and b) a plurality of fuel staging lances surrounding said flame stabilizer, each said lance having at least one ogle for staging fuel injection, each hole having a radial divergence angle and an axial divergence angle wherein said at least one hole and said divergence angles are adapted to provide a flat flame pattern;

whereby NOx emissions of less than 9 ppmv are generated at near stoichiometry conditions.

3. An ultra low NOx burner for process heating, comprising:

a) a fluid based flame stabilizer which can provide a fuel-lean flame at equivalence ratio in the range of phi=0.05 to phi=0.3; and b) a plurality of fuel staging lances surrounding said flame stabilizer, each said lance comprising a pipe having a staging nozzle at a firing end thereof, each lance having at least one hole for staging fuel injection, each hole having a radial divergence angle and an axial divergence angle wherein said at least one hole and said divergence angles are adapted to provide a load shaping flame pattern;

whereby NOx emissions of less then 9 ppmv are generated at near stoichiometry conditions.

4. The ultra low NOx burner for process heating of claims 1, 2, or 3, wherein the plurality of fuel staging lances comprises between 4 and 16 staging lances per flame stabilizer.

5. The ultra low NOx burner for process heating of claims 1, 2, or 3, wherein each staging nozzle has between 1 hole and 4 holes.

6. The ultra low NOx burner for process heating of claims 1, 2, or 3, wherein the radial divergence angle is between 8° and 24°.

7. The ultra low NOx burner for process heating of claims 1, 2, or 3 wherein the axial divergence angle is between 4° and 16°.

8. The ultra low NOx burner for process heating of claims 1, 2, or 3, wherein the nozzle is adapted to allow fuel to exit the nozzle at from 300 to 900 feet per second for natural gas staging fuel.

9. The ultra low NOx burner for process heating of claims 1, 2, or 3, wherein the fluid based flame stabilizer is a large scale vortex device.

10. The ultra low NOx burner for process heating of claims 1, 2, or 3, wherein the ultra low NOx burner is adapted to provide a fuel-lean flame that has a peak flame temperature of less than approximately 2000° Fahrenheit.

11. The ultra low NOx burner for process heating of claims 1, 2, or 3, wherein the equivalence ratio is in the range of phi=0.05 to phi=0.1.

12. The ultra low NOX burner for process heating of claims 1, 2, or 3, where in a distance from the forward end of the burner to a point where mixing of staging flame and flame stabilizer flame occurs is approximately 8 to 48 inches.

13. The ultra low NOx burner for process heating of claims 1, 2, or 3, wherein the fuel rate of the staging for natural gas fuel is from 70% to 95% of the total fuel firing rate of the burner.

14. The ultra low NOx burner for process heating of claims 1, 2, or 4, including a burner block coaxial to said flame stabilizer.

15. An ultra low NOx burner for process heating comprising:

a) a fluid based flame stabilizer in the form of a large scale vortex device which can provide a fuel-lean flame at equivalence ratio in the range of phi=0.05 to phi=0.3; and b) between 4 and 16 fuel staging lances per flame stabilizer adjacent to said flame stabilizer, each said lance comprising a pipe having a staging nozzle at a firing end thereof, each hole having a radial divergence angle and an axial divergence angle wherein the fuel staging lances surround said flame stabilizer and the at least one hole and the divergence angles are adapted to provide complete circumferential coverage of the fuel-lean flame for circular staging;

whereby NOx emissions of less than 9 ppmv are generated at near stoichiometry conditions.

16. An ultra low NOx burner for process heating, comprising: can provide a fuel-lean flame at equivalence ratio in the range of phi=0.05 to between 4 and 16 fuel staging lances per flame stabilizer adjacent to said flame stabilizer, each said lance comprising a pipe having a staging nozzle at a firing end thereof, each lance having between one and four holes for staging fuel injection, each hole having a radial divergence angle and an axial divergence angle wherein the fuel staging lances are positioned in a linear fashion in single or multiple rows on either side of the flame stabilizer and wherein the at least one hole and the divergence angles are adapted to provide a fiat flame profile;

whereby NOx emissions of less then 9 ppmv are generated at near stoichiometry conditions.

17. An ultra low NOx burner for process heating comprising:

a) a fluid based flame stabilizer in the form of a large scale vortex device which can provide a fuel-lean flame at equivalence ratio in the range of phi=0.05 to phi=0.3; and b) between 4 and 16 fuel staging lances per flame stabilizer to said flame stabilizer, each said lance comprising a pipe having a staging nozzle at a firing end thereof, each lance having between one and four holes for stealing fuel injection, each hole having a radial divergence angle and an axial divergence angle wherein the fuel staging lances are positioned in a linear fashion in single or multiple rows on either side of the flame stabilizer and wherein the at least one hole and the divergence angles are adapted to provide a flame confined between two parallel flat planes;

whereby NOx emissions of less than 9 ppmv are generated at near stoichiometry conditions.

18. The ultra low NOx burner for process heating of claims 15, 16 or 17, wherein the fuel staging lances are positioned in a geometrical fashion and almost parallel to a load geometry in a single or multiple rows and close to the flame stabilizer and wherein the at least one hole and the divergence angles are adapted to provide a flame confined between two parallel flat planes.

19. The ultra low NOx burner for process heating of claims 15, 16, or 17, wherein the radial divergence angle is between 8° and 24° and the axial divergence angle is between 4° and 16°.

20. The ultra low NOx burner for process heating of claims 15, 16, or 17, wherein the nozzle is adapted to allow fuel to exiting the nozzle at from 300 to 900 feet per second for natural gas staging fuel.

21. The ultra low NOx burner for process heating of claims 15, 16, or 17, wherein the large scale vortex device is adapted to provide a fuel-lean flame that has a peak flame temperature of less than approximately 2000° Fahrenheit.

22. The ultra low NOx burner for process heating of claims 15, 16, or 17, wherein the equivalence ratio is in the range of phi=0.05 to phi=0.1.

23. The ultra low NOx burner for process heating of claims 15, 16, or 17, wherein a distance from the forward end of the fuel pipe of the flame stabilizer to a point where mixing of staging flame and flame stabilizer flame is approximately 8 to 48 inches.

24. The ultra low NOx burner for process heating of claims 15, 16, or 17, wherein the fuel rate of the staging for natural gas fuel is from 70% to 95% of the total fuel firing rate of the burner.

25. The ultra low NOx burner for process heating of claims 15, 16, or 17, including a burner block coaxial to said flame stabilizer.

26. The ultra low NOx burner for process heating of claims 15, 16, or 17, wherein a separation distance between individual fuel lances are from about 2 to 12 inches.

* * * * *

UNITED STATES PATENT AND TRADEMARK OFFICE

CERTIFICATE OF CORRECTION

PATENT NO. : 6,773,256 B2
APPLICATION NO. : 10/067450
DATED : August 10, 2004
INVENTOR(S) : Mahendra Ladharam Joshi, Kevin Ray Heier and Aleksandar Georgi Slavejkov It is certified that error appears in the above-identified patent and that said Letters Patent is hereby corrected as shown below:

Column 15, Line 2

In Claim 2, b) after the word "stabilizer," insert the words -- each said lance comprising a pipe having a staging nozzle at a firing end thereof, --

In Claim 2, b) delete the word "ogle" and insert the word -- hole --

Column 16, Line 4

In Claim 15, b) after the words "end thereof," insert the words -- each lance having between one and four holes for staging fuel injection, --

Column 16, Line 13

In Claim 16, after the hyphenated word "comprising:" insert the words -- a) a fluid based flame stabilizer in the form of a large scale vortex device which --

Column 16, Line 14

In Claim 16, after the words "phi=0.05 to" insert the words -- phi=0.3; and b) --

Column 16, Line 34

In Claim 17 b), after the hyphenated word "stabilizer" insert the word -- adjacent --

Column 16, Line 37

In Claim 17 b), delete the word "stealing" and insert the word -- staging --

Signed and Sealed this
Eighth Day of November, 2011

David J. Kappos

David J. Kappos
*Director of the United States Patent and Trademark Office*